United States Patent [19]

Wünsch

[11] Patent Number: 4,643,018

[45] Date of Patent: Feb. 17, 1987

[54] RECTANGULAR BOX-LIKE HOUSING FOR A BENDING MACHINE

[76] Inventor: Adolf Wünsch, Ried 210, D-8959 Seeg, Fed. Rep. of Germany

[21] Appl. No.: 677,566

[22] Filed: Dec. 3, 1984

Related U.S. Application Data

[63] Continuation-in-part of Ser. No. 631,020, Jul. 17, 1984, Pat. No. 4,502,314, which is a continuation-in-part of Ser. No. 250,691, Apr. 3, 1981, abandoned.

[30] Foreign Application Priority Data

Jul. 14, 1984 [DE] Fed. Rep. of Germany ..... 3425994

[51] Int. Cl.[4] ..... B21J 13/00

[52] U.S. Cl. ..... 72/456; 72/446

[58] Field of Search ..... 72/380, 384, 388, 387, 72/449, 455, 456, 446

[56] References Cited

U.S. PATENT DOCUMENTS 4,457,160 7/1984 Wunsch ..... 72/446

*Primary Examiner*—W. D. Bray

*Attorney, Agent, or Firm*—Kuhn Muller and Bazerman

[57] ABSTRACT

In an automatic bending machine, a box-like housing is provided in which a central driving wheel is mounted for reciprocating a plurality of slide units fastened at the front wall of the housing. The front wall is a front plate which together with the slide units can be easily removed from the housing and replaced by another one the slide units of which having been set up before at another place. A plurality of interchangeable front plates can be set up with slide units and tools. Each of the front plates is provided for a work piece of predetermined form. The front plates not in use can easily be stored for a repeated use.

20 Claims, 11 Drawing Figures

FIG.4
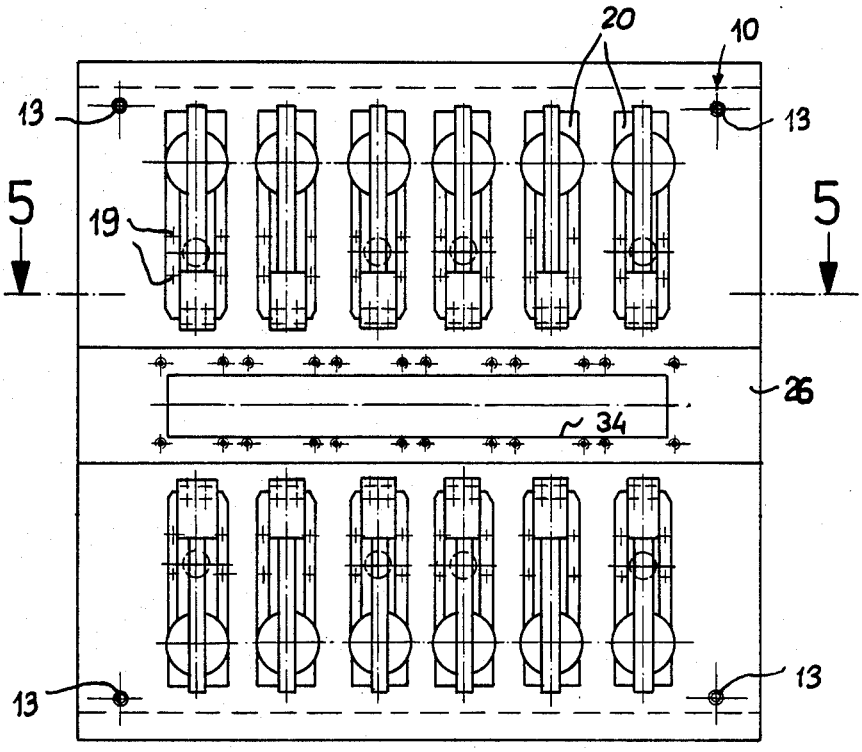
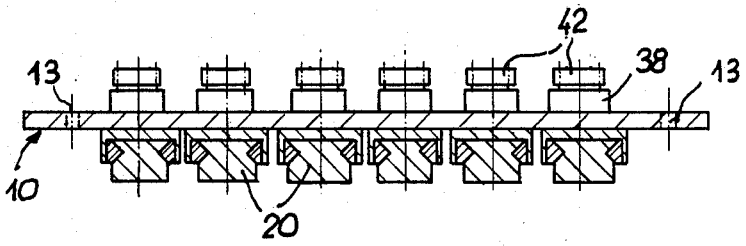
FIG.5

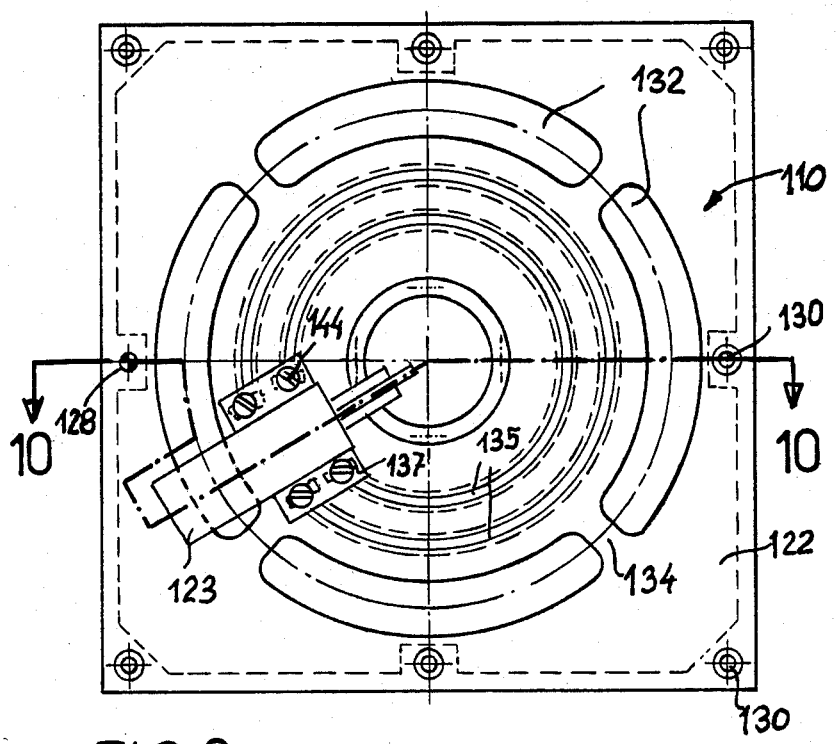
FIG.9
FIG.10
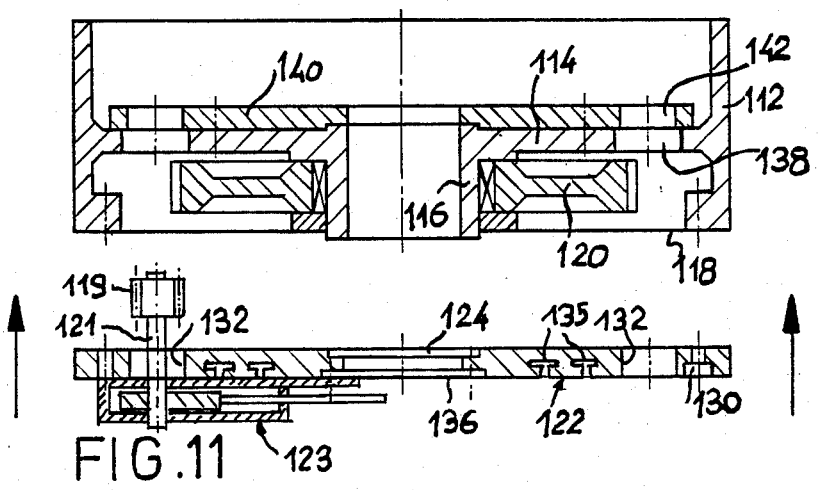
FIG.11

RECTANGULAR BOX-LIKE HOUSING FOR A BENDING MACHINE

This is a continuation-in-part application of prior pending application Ser. No. 631,020 filed on July 17, 1984 U.S. Pat. No. 4,502,314 which is a continuation-in-part application of prior application Ser. No. 250,691 filed on Apr. 3, 1981, now abandoned.

BACKGROUND OF THE INVENTION

The present invention relates to an automatic bending machine for the production of multi-form work pieces. The bending machine is used in an installation comprising a draw-in system for a band or wire stock, a punching machine and at least one bending machine, whereby all said units are mounted on a common table and are drivingly connected with a common main drive. The set up time for the bending machine is great and during this period the installation is not in use. Therefore, it can be gained from my U.S. Pat. 4,457,160 to construct the bending machine as a removable unit which as a whole can be interchanged with another unit which in a preceding period has been set up. However, the whole bending machine comprising a heavy housing, a large toothed central driving wheel within the housing and driving connections provides a high economical value which is lost during the setting-up periods. Problems exist with respect to the transportation of the heavy machine as well as with aligning and drivingly connecting it with the main drive of the installation.

SUMMARY OF THE INVENTION

Therefore, it is one object of the invention to provide a bending machine which can be reset at lower cost.

A further object is the provision of a bending machine in which only a part of the machine is involved in the resetting procedures.

One further object is the provision of a bending machine in which slide units are finally assembled for a given work piece in an inexpensive manner and stored at a depository for later use.

A further object is the separation of the housing of the bending machine and the use of only a part of this housing for resetting purposes while leaving the rest of the housing in the installation so as to maintain the driving arrangement.

It is still a further object of the invention to provide a removable front plate at the housing carrying a plurality of slide units; the front plate being easily interchangeable with another one.

Also one object is the provision of a bending machine having interchangeable front plates to provide a housing having open ends and an intermediate partition wall between which and the front plate the central driving wheel is supported whereby the housing is designed to removably fasten at the rearward side of the partition wall a second plate at least substantially corresponding to the front plate and also carrying slide units.

One further object is the provision of a bending machine, in the front plate of which a plurality of through-holes are arranged in a pair of parallel linear rows.

One further object is the provision of a central opening in the front plate between said pair of linear rows at equal distances thereto, the central opening arrangement extending over at least the most part of the length of the front plate as measured in direction of the pair of linear rows of the through-holes.

A still further object is the provision of a housing in which the front plate comprises at least two front plate parts.

Also an object is the provision of a housing which comprises an upper longitudinal mounting structure, a lower longitudinal mounting structure and a pair of side walls connecting both said mounting structures to form a hollow box, and a pair of removable front plates of identical design, which close the hollow box at the front and rearward sides.

One object is the provision of a novel driving arrangement, which comprises a plurality of equal driving elements arranged in a pair of parallel linear rows, each one of the plurality of driving elements axially aligned with one of the through-holes of the front plate respectively and wherein the drive means of the plurality of slide units are in coaxial alignment with said driving elements.

These and other objects, features and advantages will become aparent from the following description and the claims.

BRIEF DESCRIPTION OF THE DRAWINGS

FIG. 4 shows a front view of the front plate similar to that of FIG. 1, however with sliding units fastened thereon;

FIG. 5 shows a cross-sectional view of the front plate taken along line 5—5 of FIG. 4;

FIG. 9 shows a front view of a front plate of a second embodiment of a bending machine having a central working area;

FIG. 10 shows a cross-section of the housing of the bending machine along line 10—10 of FIG. 9; and FIG. 11 shows a cross-section of the front plate of the bending machine of FIG. 9.

DESCRIPTION OF PREFERRED EMBODIMENTS

Figure 1:
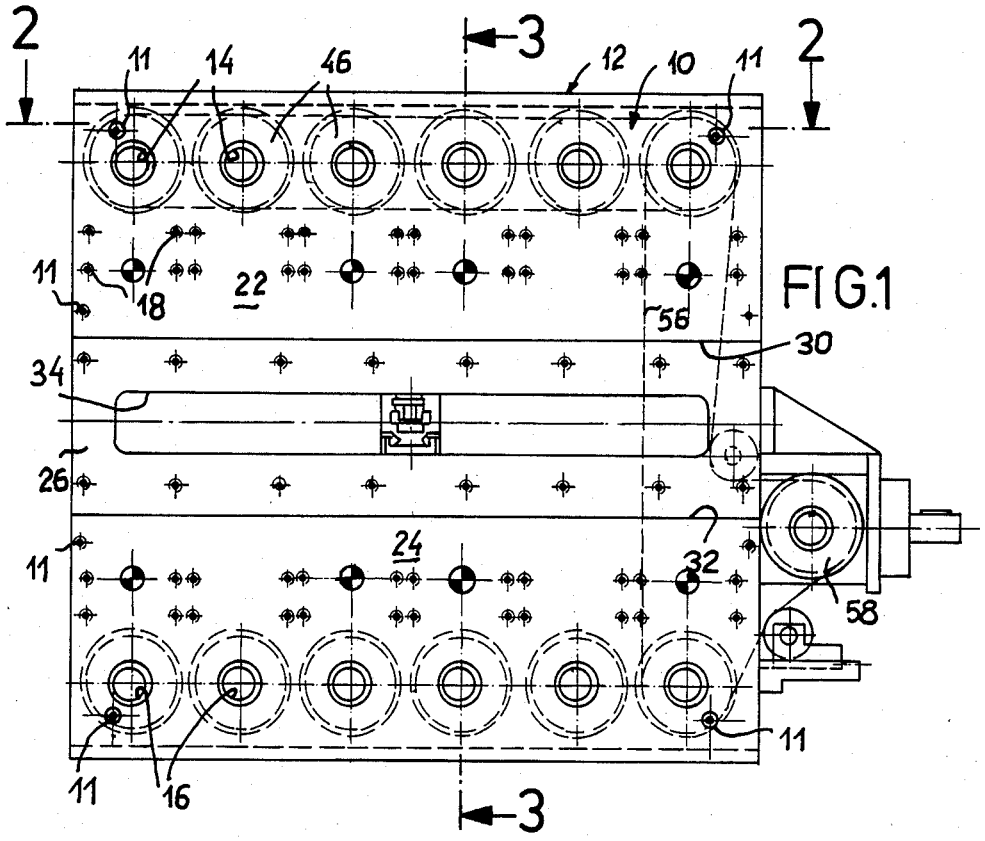
FIG. 1 shows an elevational view of a first embodiment of a bending machine with a front plate fastened thereon.
Figure 2:
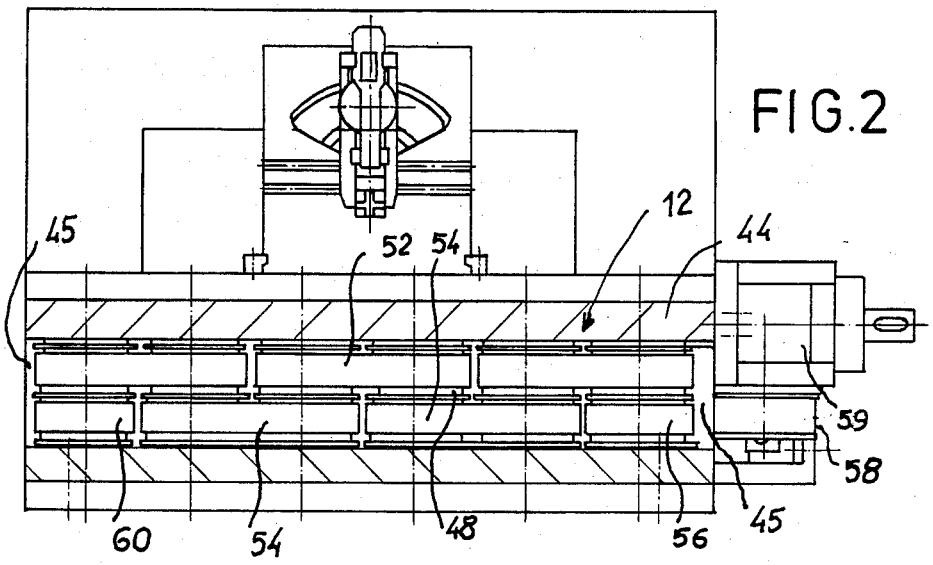
FIG. 2 shows a cross-sectional view taken along line 2—2 of FIG. 1.
Figure 3:
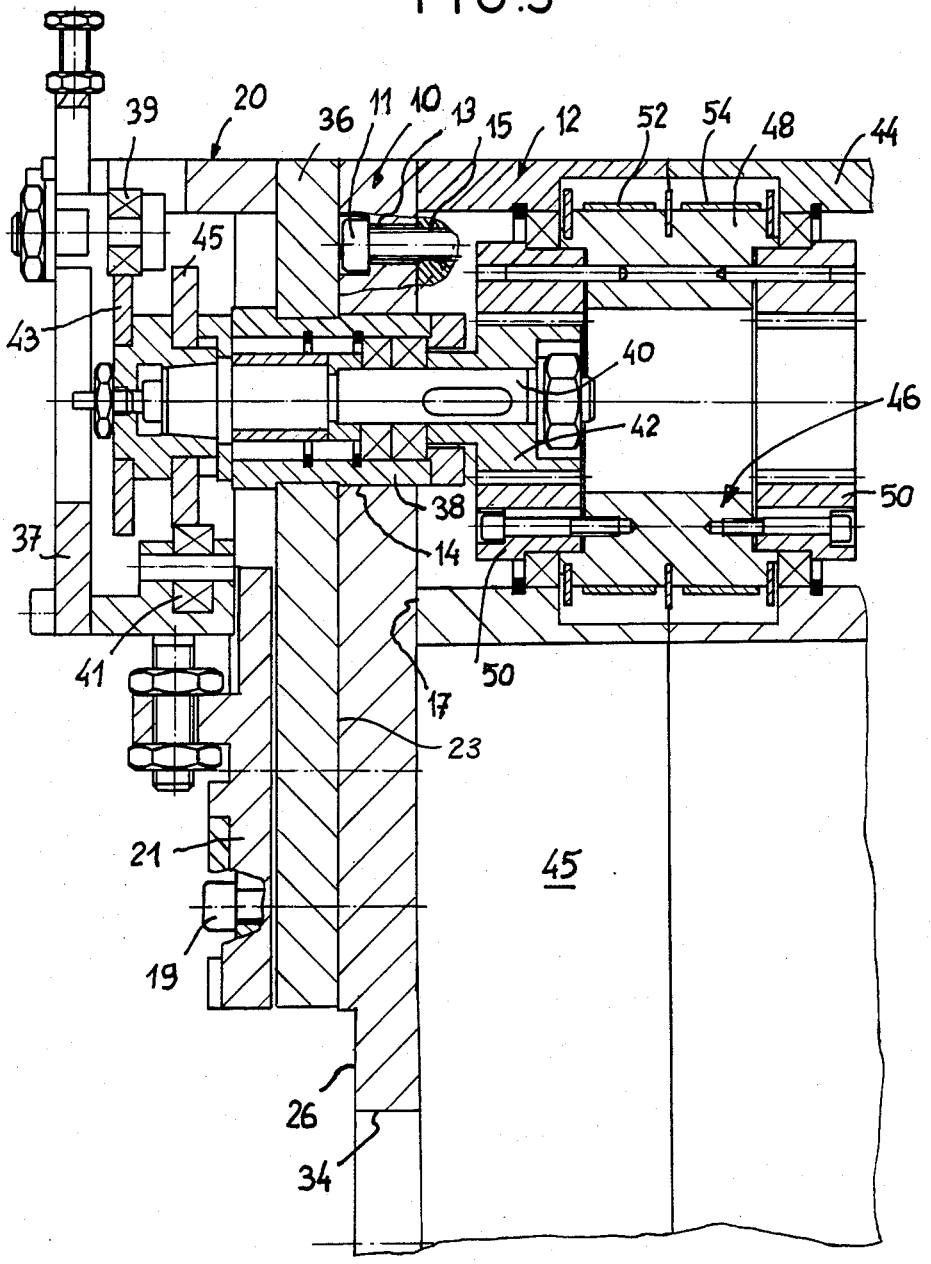
FIG. 3 shows a blown-up, fragmenarty cross-sectional view of the upper portion of the bending machine taken along line 3—3 of FIG. 1, however, with sliding units fastened thereon.

FIGS. 1 to 3 show a removable front plate 10 having the same rectangular configuration as a box-like housing 12 which is open at the front side and at the back side and at which the front plate 10 is removably fastened by screw bolts 11 which pass through holes 13 provided in the front plate 10 and which are screwed into thread holes 15 provided in the front face 17 of the housing 12 and which are aligned with holes 13. The front plate 10 is provided with a horizontal upper row of through-holes 14, and a horizontal lower row of through-holes 16. Each one of the through-holes 14 of the upper row is vertically aligned with one of the lower row respectively. Below the upper row of holes 14 and above the lower row of holes 16 mounting areas 22,24 are provided in the front plate 10 at which a plurality of slide units 20 can be fastened by screw bolts 19 screwed into thread holes 18 of the front plate 10.

Between the mounting areas 22,24 a channel 26 is recessed in the front face 23 of the front plate 10. The channel 26 has a constant height and runs continuously over the whole length of the front plate 10. The channel 26 is bordered by an upper horzontal edge 30 and a lower horizontal edge 32. Both that edges 30,32 form a guide track for rectangular work piece holders 28 (FIG. 6) which can be screwed by bolts 29 on to the bottom of the channel 26. The bottom is parallel with the front face of the front plate 10.

A rectangular central opening 34 is provided in the front plate 10 and serves for passing drive means for the work piece holder 28, central dies, calibrating pins, ejecting rams etc. The central opening 34 has a smaller height than the channel 26 and is symmetrically arranged to the horizontal center line of the front plate 10. The central opening 34 extends continuously over the most part of the length of the front plate 10. The length of the central opening 34 is substantially the same as the length of both rows of upper and lower through-holes 14, 16. The opposite ends of the central opening are spaced from the vertical edges of the front plate 10 so that the front plate 10 forms an integral rigid structure.

Any slide units 20 known in the art are suitable for use and only the main components shall be described. A frame 36 fastened at the front plate 10 has a guide track for a reciprocating tool carrier 21 which is connected with a slide 37, provided with rollers 39, 41, which engage eccentric discs 43, 45 mounted on a driving shaft 40 which is mounted for rotation in a sleeve 38 fastened at the frame 36. The sleeve 38 and the driving shaft 40 protrude from the backside of the slide unit 20 and pass through one of the through-holes 14,16. The outside diameter of the sleeve 38 is the same as the inside diameter of the through-holes 14,16, so that the sleeve 38 is fitted in the through-hole.

The driving shaft 40 projects beyond the sleeve 38 and a plug-in body 42 is fastened at the end of the driving shaft. The plug-in body 42 is in the form of a gear wheel the outside periphery thereof being provided with axially extending teeth. In another embodiment the plug-in body can have a hexagonal periphery.

The plug-in body 42 is axially coupled with a rotating body 46 by rings 50 fastened at opposite ends of the rotating body 46. The inside periphery of each one of the rings 50 is complementarily toothed in axial direction. The rings 50 form plug-in sockets for the plug-in bodies 42. After having inserted the plug-in bodies 42 into the rings 50 the corresponding driving shafts 40 are coupled with the rotating bodies 46 for a common rotation respectively.

A plurality of rotating bodies 46 are mounted for rotation in an upper longitudinal mounting structure 44 and an identical lower longitudinal mounting structure (not shown). Both mounting structures 44 have a box-like cross-section and in this embodiment consist of two halves abutting one another in the longitudinal vertical central plane and are screwed together. Both mounting structures 44 are connected with one another by side walls 45 so, that a box-like housing 12 with open front and back sides is formed.

The number and position of the rotating bodies 46 correspond exactly with that of the plurality of through-holes 14,16 in the front plate 10, so that each one of the rotating bodies 46 is axially aligned with one of the through-holes 14,16 of the removable front plate 10. An identical front plate 10 can be removably fastened at the rearward side of the housing 12, so that one rotating body 46 is in driving engagement with a pair of opposite driving shafts 40 of slide units 20. The box-like housing 12 is closed by front plates 10 at both front sides.

The plurality of rotating bodies 46 belong to a driving arrangement within the housing 12. Each rotating body 46 forms a pulley 48 comprising a pair of belt tracks lying side by side. A pair of short endless belts 52,54 are looped around both that pulley tracks. The arc of belt wrap is 180 degrees or more if intermediate deflection rollers are used. Both belts 52,54 are looped around the pulleys 48 of the both side adjacent rotating bodies 46 of the same row respectively. At one end of the housing 12 pulleys 48 of the upper and lower row of the rotating bodies 46 are coupled by a main drive belt 56, which is looped around both that end pulleys 48 and a drive pulley 58 of a gear 59 which is coupled with a driving motor (not shown). The pulleys 48 at the opposite ends of the rows of rotating bodies 46 are connected by a synchronizing belt 60.

FIGS. 4 and 5 show a front plate 10 having fastened thereto slide units 20. The front plate 10 after having mounted bending tools at the tool carriers 21 thereof is ready to be interchanged with another one which has easily be removed from the housing 12 by un-screwing the screw bolts 11.

Figure 6:
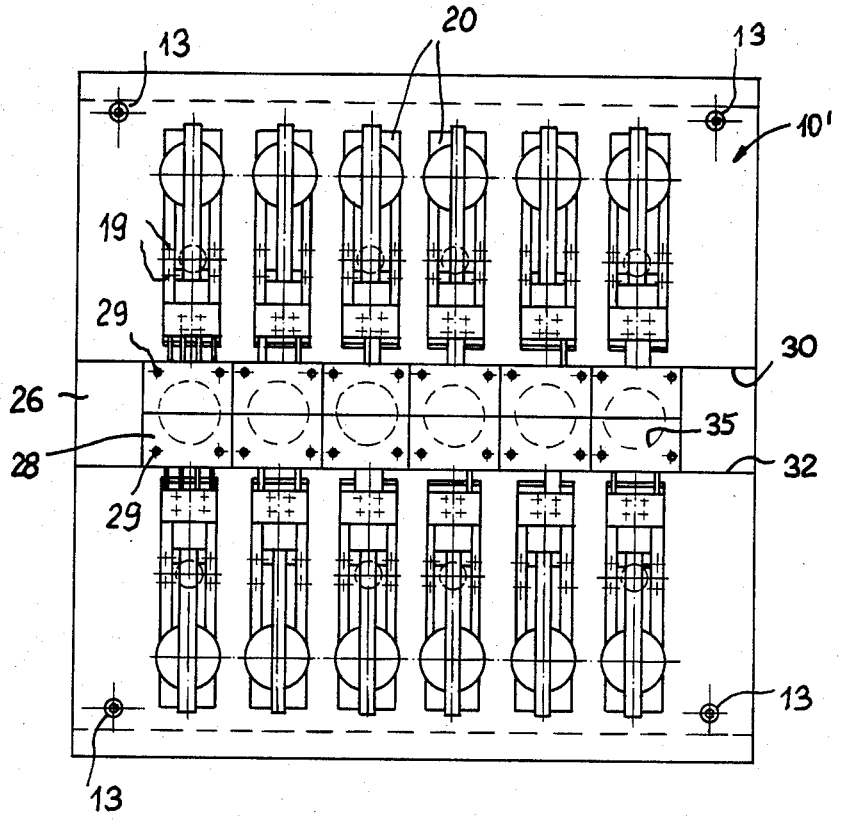
FIG. 6 shows another embodiment of a removable front plate.

FIG. 6 shows an interchangeable front plate 10' assembled with slide units 20 and ready for operation. The front plate 10' instead of a continuous rectangular central opening 34 has a central row of openings 35 each one thereof is vertically aligned respectively with a pair of vertically aligned through-holes 14,16 of both that linear rows of through-holes 14,16. Each opening 35 is covered at the front side by a two-piece work piece carrier 28 screwed on to the bottom face of the central channel 26.

Figure 7:
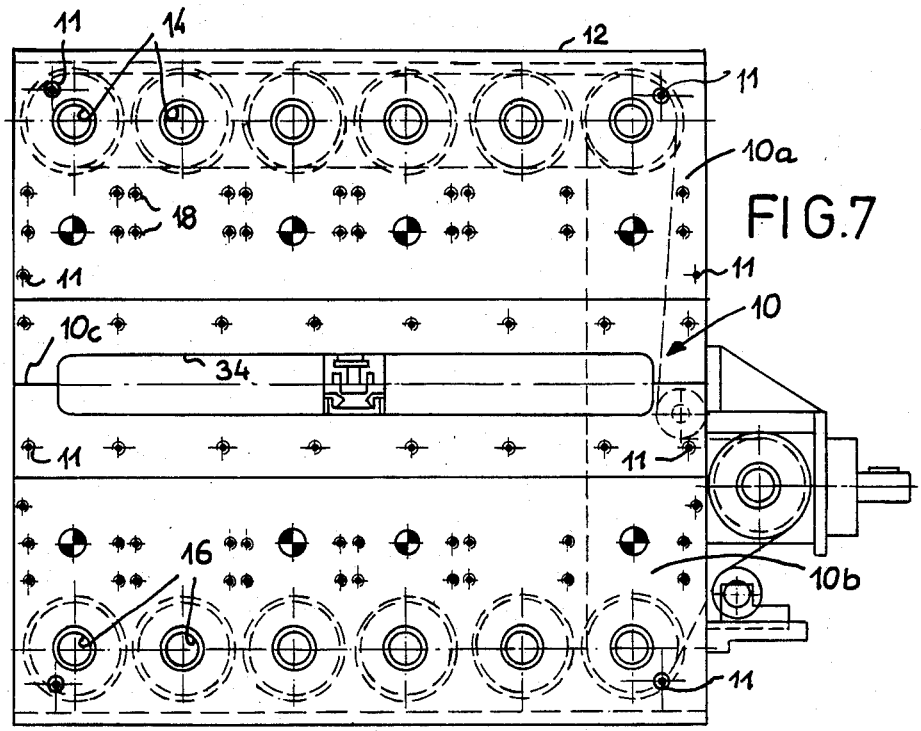
FIG. 7 shows a bending machine, the front plate of which consisting of two horizontal halves.

FIG. 7 shows a two-piece front plate 10 having an upper half 10*a* and a lower half 10*b*. Both halves 10*a*, 10*b* abut one another at a horizontal central line 10*c* of the front plate 10. This central line 10*c* is parallel with and equally spaced from the pair of rows of upper and lower through-holes 14,16. Each front plate half 10*a* und 10*b* comprises a complete row of through-holes 14,16 respectively and one half portion of the central opening 34.

Figure 8:
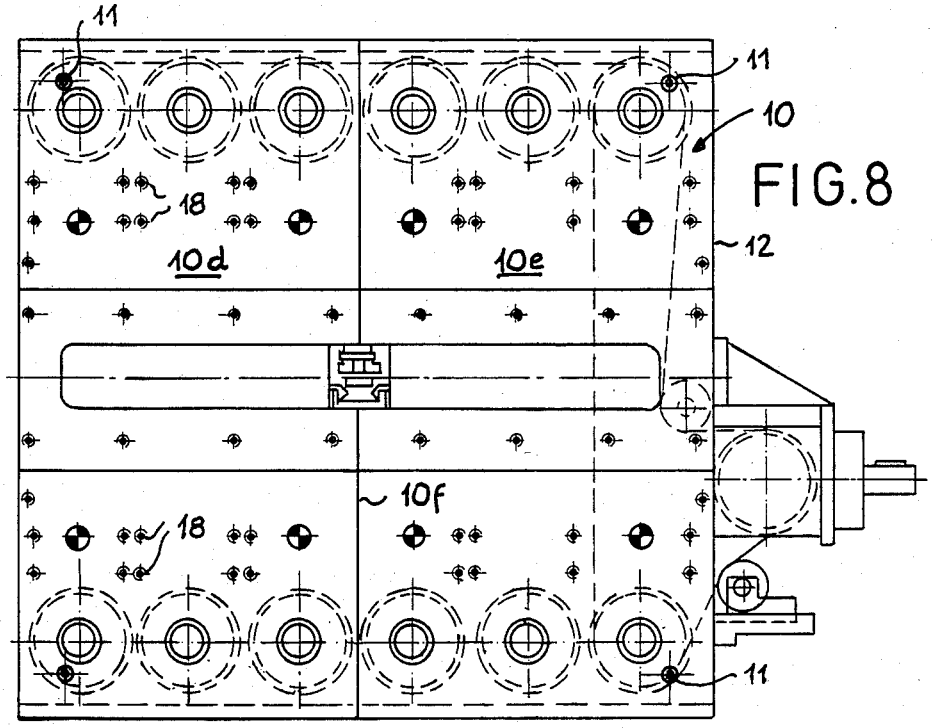
FIG. 8 shows the bending machine of FIG. 7, the front plate of which however being vertically divided in two halves.

The interchangeable front plate 10 according to FIG. 8 consists of two vertical front plate halves 10*d*, 10*e* which comprise a half set of upper and lower through-holes 14, 16 respectively and which abut one another at a vertical central line 10*f* which is at right angles with the horizontal linear rows of the through-holes 14, 16.

FIGS. 9 to 11, show another embodiment of a bending machine which differs principally from the bending machines shown in FIGS. 1 to 8 in that one central working station is provided instead of a plurality of working points arranged in series.

The bending machine 110 comprises a rectangular housing 112 with upper and lower walls and side walls. The housing is open at both ends and is provided with a partition wall 14 integrally formed with a hollow hub 116 which projects slightly beyond the front face 118 of the housing 112. A front chamber and a rearward chamber are formed within the housing 112 separated from one another by the partition wall 114 which extends in parallel relationship with a front plate 122. The partition wall 114 is integrally formed with the housing 112. A central driving gear wheel 120 is supported on the hub 116 by a ball bearing. The toothed outer circumference of the wheel 120 serves to drive pinions 119 fastened on driving shafts 121 of a plurality of slide units 123, only one of which is shown in FIGS. 9 and 11.

The removable front plate 122 has the same peripheral configuration as the front face 118 of the housing 112. The removable front plate 122 has a central opening provided with a rearward annular recess 124 and a forward annular recess 136. The hub 116 is snuggly fitted in the recess 124 and abuts against the annular face when the front plate 122 contacts the front face 118 of the housing 112. Thereby the front plate 122 is centred at the housing 112 and need only be slightly turned about its axis to align a bore 128 at one edge of the front plate 122 with a corresponding bore in the wall of the housing 112 so that a set pin can be inserted. Further, holes 130 are provided at the peripheral edges of the front plate and these holes 130 are aligned with thread holes in the walls of the housing so that the front plate can easily be screwed to the housing.

Holding units, of slide pieces 137 which have a width the same as the opening width of concentric circular recesses 135 in front plate 122, but a slightly greater length so that they can be moved by 90° in the holding position in the circular recesses 135, are inserted in the circular recesses 135 which have a T-shaped cross-section. These holding pieces are secured by bolts 144, as shown in FIG. 9, pass through side flanges of the slide units 123 and engage with the threads in the holes of the holding units 137. The front plate is provided with long curved slots 132 extending along a circular arc of slightly less than 90°. Between each pair of slots 132 a small bridge 134 is formed. The driving shafts 121 of the slide units 123 fastened at the front plate 122 project through these slots 132 and the pinions 119 at the ends of the driving shafts 121 are brought in engagement with the central wheel 120 when the front plate 122 is mounted. The curved slots 132 are arranged with an equal radial distance from the central opening of plate 122.

The partition wall 114 in connection with the hollow hub 116 provides a rigid bracing allowing a thin-walled housing.

The additional central support of the front plate 122 by the hub 116 allows a thin-walled front plate 122.

The partition wall 114 of the housing 112 is provided with a slot arrangement 138 substantially equal with that of the front plate 122. Although in FIG. 10 the slots 138 of the partition wall 114 are shown slightly broader than those of the front plate 122, they can be made of equal width. A mounting plate 140 is removably fastened at the backside of the partition wall 114. This mounting plate 140 is pre-assembled with slide units (not shown) at the backside of which and also is provided with a slot arrangement 142 which is identical with that of the front plate 122. The driving shafts (not shown) therefore protrude through the aligned slots 142, 138 and the pinions (not shown) of which engage with the central wheel 120. By this arrangement, many more slide units 123 can be operated in one bending machine and driven by the common central wheel 120.

Because the mounting plate 140 is supported at its whole surface at the partition wall 114, it can be fastened by screws in a number of ways, for example, as shown in FIG. 2. However, one prefered embodiment consists of using a mounting plate 140 of the same size and configuration as the front plate 122 so that only one type of mounting plates carrying slide units 123 is used. They are interchangeable. This requires that the rearward face of the partition wall be at least equal with the front face 118 of the housing 112. Therefore, at least the inner circumference of the housing walls in the region rearward of the partition wall must be larger than the inner circumference in front of the partition wall 114.

I claim:

1. A rectangular box-like housing for a bending machine, comprising a housing having a front wall with a front face, a driving means within said housing, a plurality of slide units removably fastened to the front face of the front wall, each one of said plurality of slide units comprising a reciprocally mounted tool carrier and a drive mechanism for said slide unit, said drive mechanism including rotation means mounted in a frame of the slide unit coupled with the driving means by a plug-in connector means, the front wall being a plate having a plurality of through-holes, with the connector means of each one of the plurality of slide units passing through one of the plurality of through-holes in the front plate, the front plate together with said plurality of slide units fastened thereon being removably fastened to a front face of the housing with the connector means forming a plug-in connection with said driving means.

2. A rectangular box-like housing as claimed in claim 1, wherein the housing comprises a partition wall extending in parallel relationship with said front plate and being integrally formed with said housing, the partition wall separating said housing into a front chamber and a rearward chamber within said housing, wherein an elongated central hollow hub is integrally formed with said partition wall and extends axially through said front chamber and wherein the driving means comprises a central driving gear wheel rotably mounted on said hollow hub, and said front plate being provided with a central opening, said hollow hub protruding into said central opening for centering said front plate and said plurality of through-holes being arranged at an equal radial distance from said central opening.

3. A rectangular box-like housing as claimed in claim 2, wherein the plurality of openings in said front plate comprise circular arc slots, and further comprising small radial bridges between said circular arc slots.

4. A rectangular box-like housing as claimed in claim 2, further comprising a mounting plate removably fastened in said rearward chamber at a rearward side of said partition wall, said mounting plate having a central opening coaxially arranged with the central opening of said front plate, said mounting plate having through-holes which are radially arranged for axial alignment with the through-holes of said front plate, and wherein said partition wall has corresponding openings as through-holes aligned with those of said mounting plate.

5. A rectangular box-like housing as claimed in claim 1, wherein the plurality of through-holes in the front plate are arranged in a pair of parallel linear rows.

6. A rectangular box-like housing as claimed in claim 5, wherein an upper row of through-holes and a lower row of through-holes are provided and each one of the through-holes of one row is vertically aligned with one of the other row respectively.

7. A rectangular box-like housing as claimed in claim 5, wherein the front plate has a central opening arrangement between said pair of linear rows at equal distance therefrom, the central opening arrangement extending over at least most of the length of the front plate as measured in direction of the pair of linear rows of the through-holes.

8. A rectangular box-like housing as claimed in claim 7, wherein a central opening arrangement comprises one rectangular continuous elongate opening of constant height.

9. A rectangular box-like housing as claimed in claim 7, wherein the central opening arrangement comprises a row of separate openings each one thereof vertically aligned respectively with a pair of vertically aligned through-holes of said pair of linear rows of through-holes.

10. A rectangular box-like housing as claimed in claim 7, wherein a channel is recessed in the front face of the front plate having a constant height with the central opening arrangement therein.

11. A rectangular box-like housing as claimed in claim 10, wherein a work piece holder is fitted in said channel and fastened therein.

12. A rectangular box-like housing as claimed in claim 11, wherein the channel is provided with an upper and a lower linear edge, and wherein said edges form a guide track for the work piece holder.

13. A rectangular box-like housing as claimed in claim 5, wherein the front plate comprises at least two front plate parts.

14. A rectangular box-like housing as claimed in claim 13, wherein the front plate comprises two halves abutting one another at a horizontal center line parallel with and equally spaced from said pair of rows of through-holes.

15. A rectangular box-like housing as claimed in claim 13, wherein the front plate comprises two halves abutting one another at a vertical center line intersecting said pair of rows of through-holes at right angles and in the center thereof.

16. A rectangular box-like housing as claimed in claim 5, wherein the driving means comprises a plurality of equal driving elements arranged in pair of parallel linear rows, each one of the plurality of driving elements being axially aligned with one of the through-holes of the front plate respectively and wherein the drive mechanism of the plurality of slide units are in coaxial alignment with said driving elements.

17. A rectangular box-like housing as claimed in claim 16, wherein the connector means comprises a shaft protruding from a backside of the slide unit, passing through one of said plurality of through-holes and comprising a plug-in-type connection end, which is coupled for rotation with the drive mechanism rotation means.

18. A rectangular box-like housing as claimed in claim 17, wherein the driving element is a rotating body provided with a central opening the periphery of which being toothed axially and wherein the outside periphery of the rotating body is partly looped by a pair of belts lying side by side, said pair of belts looped around the pair of adjacent rotating bodies of the same row of driving elements respectively.

19. A rectangular box-like housing as claimed in claim 1, wherein the housing includes thread-holes in a front face thereof, and wherein the front plate has the same peripheral shape as the housing, the front plate having holes aligned respectively with thread-holes in the front face of the housing.

20. A rectangular box-like housing as claimed in claim 1, wherein the housing comprises an upper longitudinal mounting structure, a lower longitudinal mounting structure and a pair of side walls connecting both said mounting structures to form a hollow box and a pair of removable front plates of identical design, which close the hollow box at the front and rearward sides.

* * * * *